US009132468B2

(12) United States Patent
Maisch

(10) Patent No.: US 9,132,468 B2
(45) Date of Patent: Sep. 15, 2015

(54) DEVICE AND METHOD FOR EXPANDING METAL ELEMENTS

(75) Inventor: Christof Maisch, Gaggenau (DE)

(73) Assignee: Protektorwerk Florenz Maisch GmbH & Co. KG, Gaggenau (DE)

( * ) Notice: Subject to any disclaimer, the term of this patent is extended or adjusted under 35 U.S.C. 154(b) by 366 days.

(21) Appl. No.: 13/876,083

(22) PCT Filed: Sep. 20, 2011

(86) PCT No.: PCT/EP2011/004685

§ 371 (c)(1),
(2), (4) Date: Jul. 12, 2013

(87) PCT Pub. No.: WO2012/041453

PCT Pub. Date: Apr. 5, 2012

(65) Prior Publication Data

US 2013/0283592 A1 Oct. 31, 2013

(30) Foreign Application Priority Data

Oct. 1, 2010 (DE) ..... 10 2010 047 310

(51) Int. Cl.

| | |
|---|---|
| ***B21D 31/04*** | (2006.01) |
| ***B21D 47/04*** | (2006.01) |
| ***E04C 3/08*** | (2006.01) |
| ***E04C 3/09*** | (2006.01) |
| *E04C 3/04* | (2006.01) |

(52) U.S. Cl.

CPC ..... *B21D 47/04* (2013.01); *E04C 3/086* (2013.01); *E04C 3/09* (2013.01);
(Continued)

(58) Field of Classification Search

CPC ..... B21D 1/02; B21D 3/02; B21D 5/14; B21D 31/04; B21D 31/043; B21D 31/046; B21D 47/00; Y10T 29/301; Y10T 29/307; Y10T 29/496; Y10T 29/49631; Y10T 29/5116

See application file for complete search history.

(56) References Cited

U.S. PATENT DOCUMENTS

| | | | |
|---|---|---|---|
| 3,874,051 | A | 4/1975 | Malik |
| 4,896,818 | A | 1/1990 | Shteinbok |

FOREIGN PATENT DOCUMENTS

| | | | |
|---|---|---|---|
| DE | 17 77259 | A1 | 4/1970 |
| DE | 196 40 612 | C1 | 6/1998 |

(Continued)

OTHER PUBLICATIONS

Translation of German Search Report dated Jul. 8, 2011 relating to German Patent Application No. 10 2010 047 310.3.

(Continued)

*Primary Examiner* — Christopher Besler

(74) *Attorney, Agent, or Firm* — Gifford, Krass, Sprinkle, Anderson & Citkowski, P.C.

(57) ABSTRACT

An apparatus is described which is formed for expanding elongated, ribbon-shaped metal elements moving in the longitudinal direction and suitable for forming open section elements such as upright sections or plaster sections or closed section elements such as passages or pipes, the apparatus includes a feed station, a cutting station, a positioning station and a connection station, with the feed station being formed for the at least substantial continuous feed of at least one metal element to the cutting station. The cutting station is formed for producing at least one continuous meandering incision which extends in the longitudinal direction of the at least one metal element and by which at least two longitudinal portions of the at least one metal element having meandering longitudinal edges are produced. The positioning station includes at least one in particular rotating or circulating positioning device having a plurality of positioning elements, with the positioning elements being formed for engaging into openings formed in the at least one metal element and for positioning portions of the meandering longitudinal edges in defined positions with respect to one another. The connection station is formed for connecting the mutually positioned portions of the meandering longitudinal edges. A method is furthermore described for expanding corresponding metal elements.

30 Claims, 6 Drawing Sheets

Figure 1:
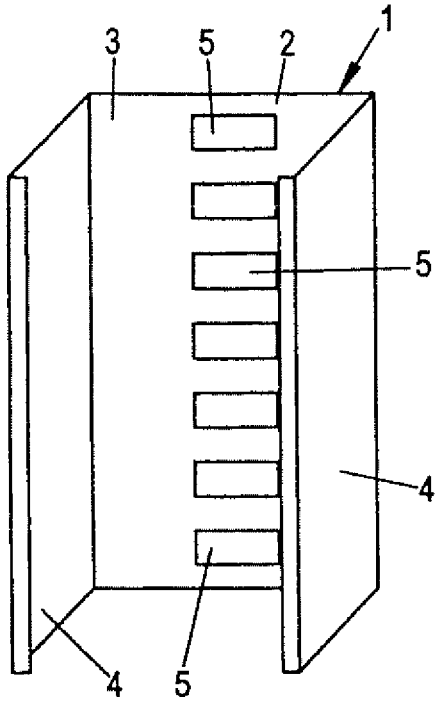

(52) U.S. Cl.
CPC ..... *E04C 2003/0413* (2013.01); *E04C 2003/0434* (2013.01); *E04C 2003/0473* (2013.01); *Y10T 29/49826* (2015.01); *Y10T 29/5116* (2015.01); *Y10T 29/5122* (2015.01)

(56) References Cited

FOREIGN PATENT DOCUMENTS

| | | | |
|---|---|---|---|
| DE | 699 13 926 | T2 | 7/2004 |
| DE | 10 2004 029 230 | A1 | 1/2006 |
| DE | 10 2009 048 152 | A1 | 4/2011 |
| DE | 10 2010 026 320 | A1 | 1/2012 |
| FR | 1 536 339 | A | 8/1968 |
| JP | 48012335 | | 10/1973 |
| WO | 2011/038879 | A2 | 4/2011 |

OTHER PUBLICATIONS

International Search Report dated Mar. 14, 2012 relating to PCT/EP11/004685.

DEVICE AND METHOD FOR EXPANDING METAL ELEMENTS

CROSS-REFERENCE TO RELATED APPLICATIONS

This application is the U.S. National Phase of PCT/EP2011/004685 filed Sep. 20, 2011, which claims priority of German Patent Application 10 2010 047 310.3 filed Oct. 1, 2010.

The present invention relates to an apparatus and to a method for expanding elongated ribbon-like metal elements moving in the longitudinal direction and suitable for forming open section elements such as upright sections or plaster sections or closed section elements such as passages or pipes. The invention is further directed to a corresponding method for expanding such metal elements.

Such metal elements are described, for example, in the German patent application, not pre-published, DE 10 2010 026 320. These metal elements have two longitudinal portions having meandering longitudinal edges which are connected to one another section-wise to produce a metal element widened with respect to the original ribbon-like metal element without any additional material effort.

It is problematic in this respect to connect the separate longitudinal portions of the metal element to one another at a high feed speed in inline operation with an economically justifiable effort. The portions of the longitudinal edges to be connected, preferably to be welded, must be set exactly at one another to be able to ensure the desired quality of the connections. To achieve a sufficiently high throughput, this must also be ensured at the usually high speeds such as occur in inline production (for example 40m/min to more than 100 m/min).

It is therefore an object of the present invention to provide an apparatus and a method of the initially named kind which ensure a high throughput with a simultaneously simple and reliable construction.

In accordance with the invention, this object is satisfied by an apparatus of the initially named kind having a feed station, a cutting station, a positioning station and a connection station, with the feed station being formed for the at least substantially continuous feed of at least one metal element to the cutting station; the cutting station being formed for producing at least one continuous, meandering incision which extends in the longitudinal direction of the at least one metal element and by which at least two longitudinal portions of the at least one metal element having meandering longitudinal edges are produced; the positioning station including at least one positioning device, in particular a rotating or circulating positioning device, having a plurality of positioning elements, with the positioning elements being formed for engaging into openings formed in the at least one metal element and for positioning portions of the meandering longitudinal edges with respect to one another in predefined positions; and with the connection station being formed for connecting the mutually positioned portions of the meandering longitudinal edges.

In the method in accordance with the invention, the at least one metal element is supplied from a feed station at least substantially continuously to a cutting station; at least one continuous meandering incision which extends in the longitudinal direction of the at least one metal element is produced in the cutting station by which incision at least two longitudinal portions of the at least one metal element having meandering longitudinal edges are formed; the longitudinal portions are guided by a positioning station such that positioning elements provided at a positioning device, in particular a rotating or circulating positioning device, engage into openings formed in the at least one metal element so that portions of the meandering longitudinal edges are mutually positioned in predefined positions and the mutually positioned portions of the meandering longitudinal edges are connected to one another in a connection station.

An automatic and exact alignment of the portions of the meandering longitudinal edges to be connected with respect to one another thus takes place by the invention so that the longitudinal portions of the metal element can be connected to one another at high speed. The section elements can thereby be manufactured in inline processes at a high throughput in an economical manner.

In accordance with an advantageous embodiment of the invention, an offset station for forming a loop, in particular a slack loop, of at least one of the longitudinal portions of the metal element is provided between the cutting station and the positioning station so that the mutually separate longitudinal portions of the at least one metal element can be offset with respect to one another in the longitudinal direction and/or in the transverse direction. Since the guided metal elements have a relatively high stiffness in the longitudinal direction and the transverse direction, a mutual offset in the longitudinal direction or transverse directions is advantageously carried out using a corresponding offset station. The loop can in this respect only include one or more longitudinal portions of the metal element or all longitudinal portions, i.e. the total metal element. A slack region of the at least one metal element or of the longitudinal portion or portions is produced within the production line by the loop which is formed and it is ensured by said slack region that the longitudinal portions of the at least one metal element can be mutually offset both in the longitudinal direction and, or alternatively, in the transverse direction. The mutual displacement of the two longitudinal portions or the separation of the longitudinal portions required for the final positioning of the portions of the meandering longitudinal edges to be connected to one another can be achieved without problem in this manner. The respective offset transversely or longitudinally to the direction of transport is in this respect defined by the desired kind of connection of the two longitudinal portions, as will be explained in even more detail within the framework of this application.

In accordance with a further advantageous embodiment of the invention, two respective rows of positioning elements are provided which are disposed next to one another in the direction of transport. Depending on the kind of connection of the two longitudinal portions, it is, however, also possible that the positioning device only includes one row of positioning elements disposed behind one another.

Depending on the arrangement of the openings in the at least one metal element, the positioning elements of the two rows can be arranged not mutually offset or mutually offset in the transport direction. It is equally dependent on the arrangement of the openings whether one row of positioning elements disposed behind one another or two rows of positioning elements arranged next to one another in the transport direction are provided.

The positioning device is advantageously formed as a toothed wheel, a toothed belt or as a gear rack or as a chain conveyor or belt conveyor having positioning elements. Other elements suitable for feeding and having corresponding positioning elements can also form a positioning device in accordance with the invention.

In accordance with a further advantageous embodiment, the positioning elements have, in particular in their base surface, a cross-sectional shape formed substantially complementary to the openings of the at least one metal element. A shape-matched connection between the positioning elements and the openings of the at least one metal element can thereby be achieved so that the portions of the meandering longitudinal edges to be welded to one another can be exactly aligned to one another.

In accordance with a further preferred embodiment of the invention, the positioning elements are formed for engaging into openings formed by the meandering longitudinal edges. Such openings can be produced in that the longitudinal portions are mutually displaced in the transverse direction or in the transverse and longitudinal directions after introduction of the meandering incision.

It is, however, also possible that the positioning elements are formed for engaging in openings provided independently of the meandering longitudinal edges in the at least one metal element, in particular in its marginal regions. The positioning device can in this case be formed in the manner of a traction apparatus, for example as a chain conveyor having needle grippers. An exact positioning of the portions to be mutually connected is also ensured in this case by the fixed spacings between the openings provided in the marginal regions and the portions of the meandering longitudinal edges provided for welding.

The feed station advantageously includes a reel on which the at least one metal element is wound. In this manner, a uniform feed of the at least one metal element to the other stations of the apparatus in accordance with the invention can be achieved. The feed station can advantageously include an apparatus for welding together mutually following metal elements. On a complete unwinding of the at least one metal element from the reel, continuous operation can thereby be maintained in that a respect further metal element is welded to the end of the preceding metal element.

In accordance with a further preferred embodiment of the invention, an straightening station for the at least one metal element and the longitudinal portions produced therefrom is provided between the feed station and the cutting station and/or between the cutting station and the positioning station. Irregularities in the surface or stresses in the at least one metal element, which arise, for example, by welding of two mutually following portions on the exchange of a coil of the feed reel or on the production of the meandering incision, can thereby be compensated. Bent-up portions of the at least one metal element, which can arise in the cutting process, can in particular again be bent back into the plane of the respective metal ribbon, for example.

The positioning device is advantageously actively driven. This means that the positioning device acts as a feed device for the at least one metal element. It is, however, generally also possible that the positioning device is only passively driven and a separate feed device is provided. In this case, only the positioning of the two longitudinal portions with respect to one another is effected by the positioning device, whereas the actual forward movement of the at least one metal element is achieved by a separate feed device.

The positioning station is advantageously arranged in front of the connection station, in particular in the run-in region of the connection station, i.e. closely in front of the connection station. It is, however, also possible that the positioning station is arranged after the connection station, in particular in the run-out region of the connection station, i.e. close to the outlet of the connection station.

In accordance with a further advantageous embodiment, the connection station includes a lateral belt guide by which the longitudinal portions of the at least one metal element are mutually positioned and in particular held together so that the portions of the meandering longitudinal edges to be welded together contact one another, in particular under pressure. It is achieved in this manner that the positioning of the portions of the meandering longitudinal edges to be connected to one another achieved by the positioning station is also exactly observed within the connection station. It can in particular be achieved by the pressing together of the portions of the meandering longitudinal edges to be connected to one another that an exact connection seam, in particular an exact weld seam, can be produced.

The connection station can advantageously include a vertical belt guidance by which the longitudinal portions of the at least one metal element are guided substantially in the same plane or lying areally over one another. A high quality of the connection and in particular an ideal surface of the metal ribbon are also thereby achieved.

The cutting station can advantageously include a rotational cutting apparatus or a laser cutting apparatus. A stroke cutting process is generally also conceivable if it is made so that a substantially continuous manufacturing process is made possible.

Equally preferably, the connection station is made as a welding station which in particular includes a laser welding apparatus. Very exact and clean weld seams can be produced using a laser welding apparatus so that the quality of the section element produced is very high. Furthermore, a very small region of great heat is produced at the two contacting edges of the longitudinal portions by a laser welding process.

The melted zone produced by the laser welding process in this region has a much smaller transverse extent than a correspondingly melted zone in other fusion welding connections so that an increased strength of the final metal section is achieved exactly in the center between the two longitudinal portions.

A feed unit for the at least one metal element can advantageously be provided after the connection station, in particular in the form of a roll guide. A stamping station and/or a reshaping station for the at least one metal element can furthermore likewise preferably be provided after the connection station by which stamping station/reshaping station, on the one hand, desired stampings in the form of stiffening beads or deep-drawn regions can be produced, in particular in the region of the openings, and, on the other hand, the cross-section of the at least one metal element can be brought into an intermediate shape or into its final shape. The at least one metal element can, for example, be reshaped into a C-section or a U-section or any other suitable open, or also closed, section.

On use of a laser welding process, the laser beam is preferably moved during the welding process along with the moving at least one metal element, with the forward movement of the laser beam being slower than the transport speed of the at least one metal element. In this respect, in particular the forward movement of the laser beam and thus the welding speed can be substantially half as fast as the transport speed of the at least one metal element.

In each case after welding of two mutually positioned portions of the meandering longitudinal edges, the laser beam can advantageously be positioned onto portions of the meandering longitudinal edges disposed opposite to the direction of transport and these can subsequently welded to one another.

Since the welding speed is restricted in laser welding, a higher transport speed of the at least one metal element can be achieved in this manner with respect to the maximum welding speed. The maximum welding speed is only defined by the relative speed between the laser beam and the at least one metal element due to the moving of the laser beam along with the moving at least one metal element during the welding process. The absolute transport speed of the at least one metal element can thereby be higher than the maximum possible welding speed. Since no uninterrupted weld connection, but rather only an interrupted connection, is necessary due to the meandering longitudinal edges, the laser beam can be positioned at high speed at the portion disposed against the transport direction and to be welded next after respectively producing a part weld connection. The connection of these next portions can then in turn be produced by moving along the laser beam at reduced speed with respect to the transport speed.

In this respect, it is generally also possible that a plurality of laser beams are used in parallel which each weld mutually following portions of the meandering longitudinal edges to one another. After the welding process has taken place, the laser beams can then be offset in parallel by a corresponding plurality of portions and can be repositioned. The transport speed of the metal element can be increased even further in this manner.

At least two metal elements contacting one another areally can advantageously be fed to the cutting station and the metal elements contacting one another can jointly be divided by the meandering incision in the cutting station into two longitudinal portions each, with the respective longitudinal portions of the metal elements disposed on the same side of the meandering incision contacting one another and respective portions of the meandering longitudinal edges of the mutually contacting longitudinal portions respectively extending in the longitudinal direction forming directly mutually contacting connection edges, the one mutually connecting longitudinal portions being separated from the other mutually connecting longitudinal portions, the connection edges of the one longitudinal portion being mutually connected, in particular welded, to the connection edges of the longitudinal portion contacting it and one of the two longitudinal portions being pivoted about the connection edges with respect to the other longitudinal portion connected to it so that the longitudinal portions are mutually connected along bent over abutting edges and the openings being formed between portions of the meandering longitudinal edges.

In this embodiment, it is thus not an individual metal element which is cut by the meandering incision into two longitudinal portions which are then mutually displaced and ultimately connected to one another, but rather at least two areally contacting metal elements are used as the starting material. They are provided while mutually contacting with a common meandering incision so that each of the metal elements is divided into two longitudinal portions. Unlike the other embodiments, the at least two mutually contacting longitudinal portions, i.e. one longitudinal portion from the one and one longitudinal portion from the other metal element or elements are each connected to one another along the connection edges and are ultimately unfolded to form the desired section element with openings. The individual processing steps of the two halves separated by the meandering incision can in this respect be carried out in parallel in the same respective stations or in separate stations. A plurality of meandering slits can generally also be introduced so that a plurality of longitudinal portions are formed.

Further advantageous embodiments of the invention are set forth in the dependent claims.

Figure 2:
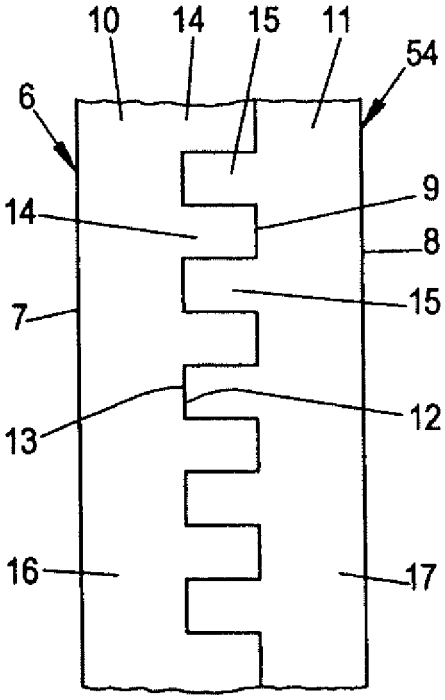
Figure 3:
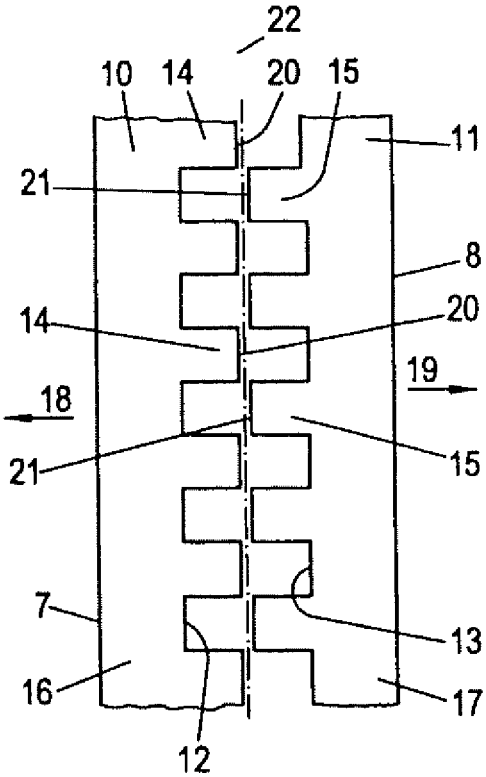
Figure 4:
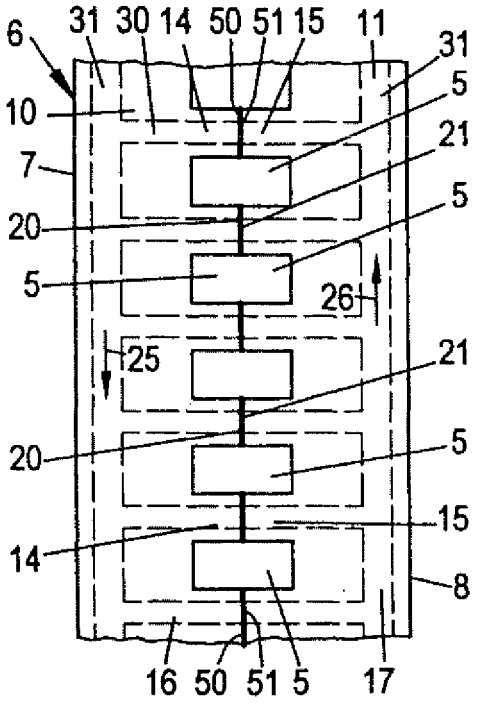
Figure 5:
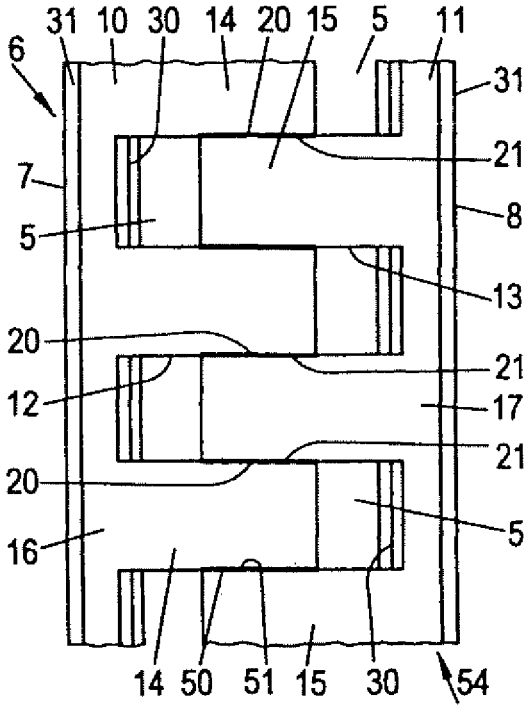
Figure 6:
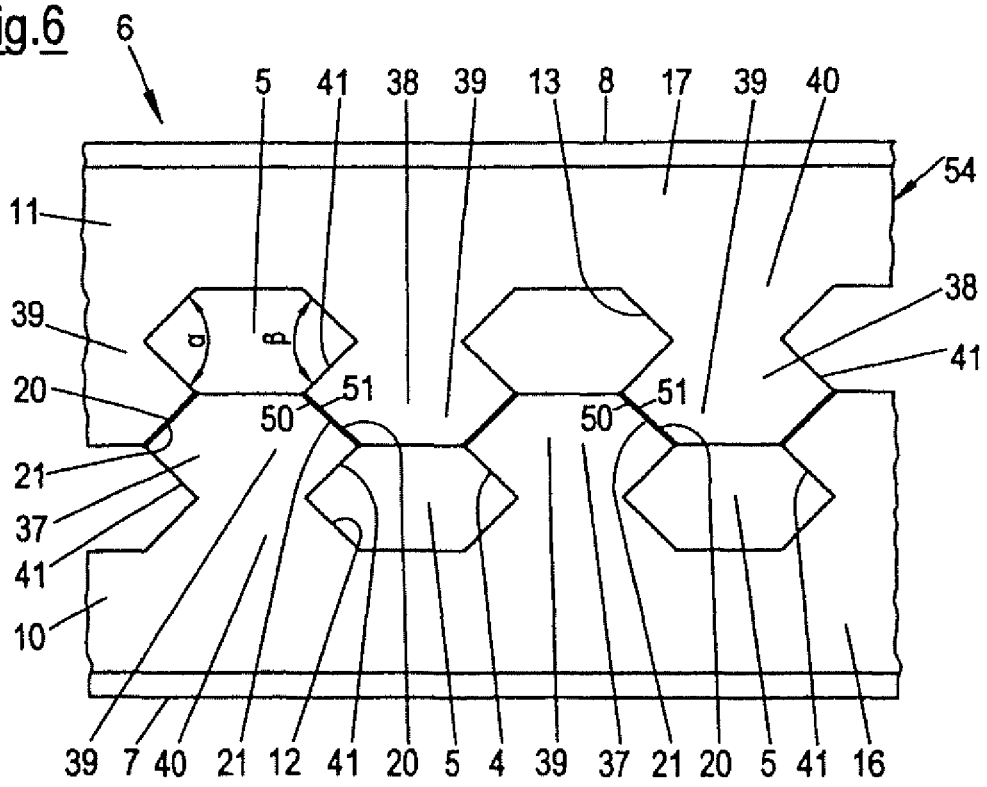
Figure 7:
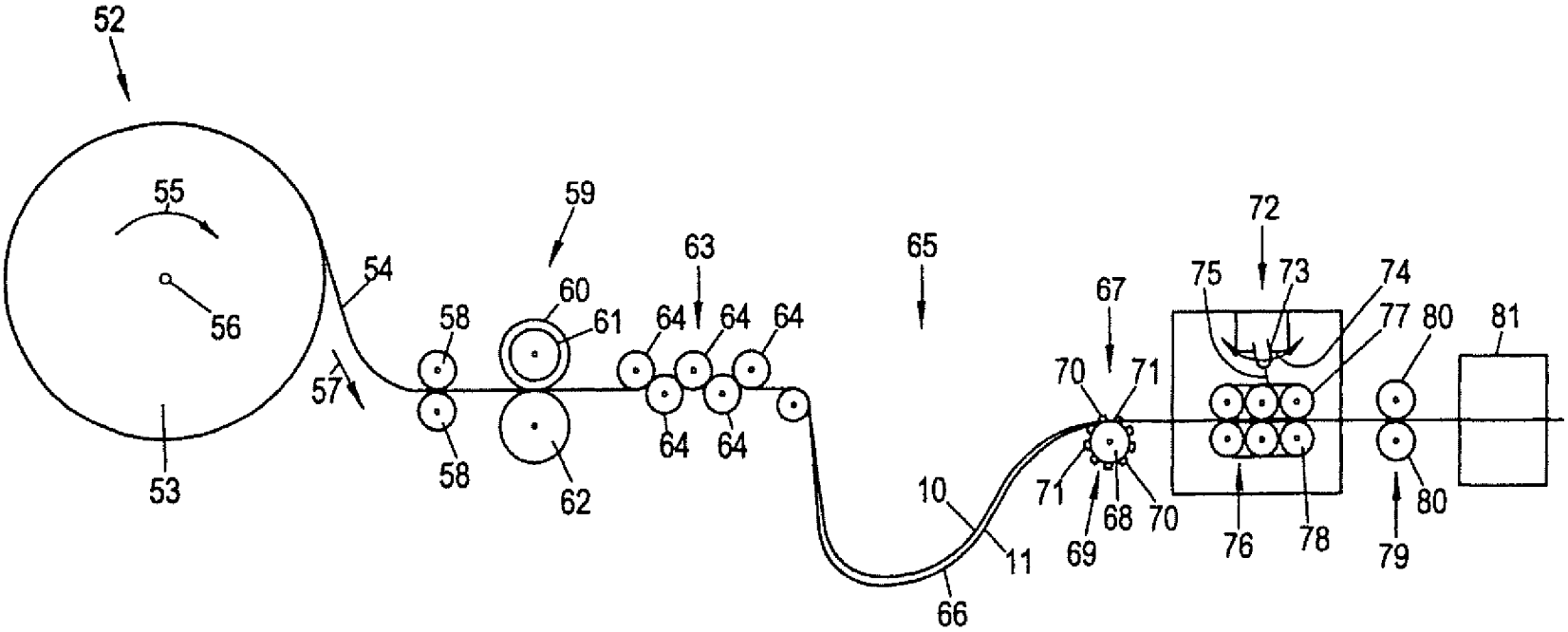
Figure 8:
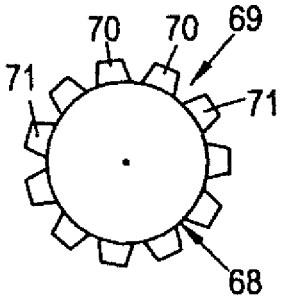
Figure 9:
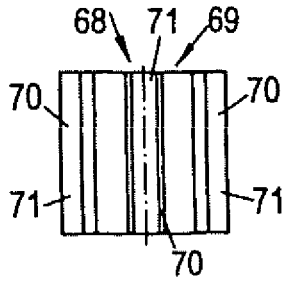
Figure 10:
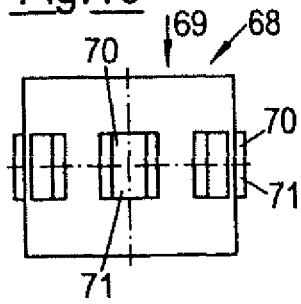
Figure 11:
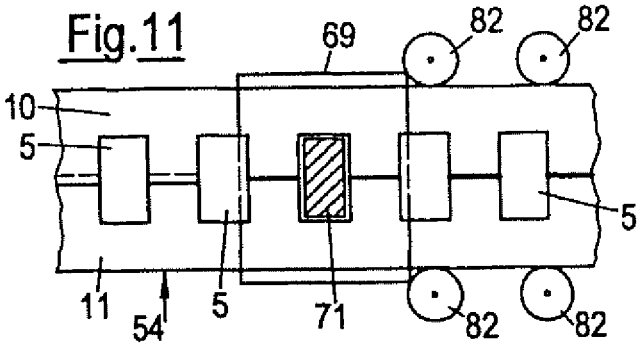
Figure 12:
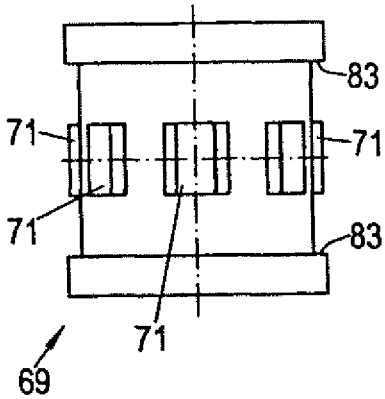
Figure 13:
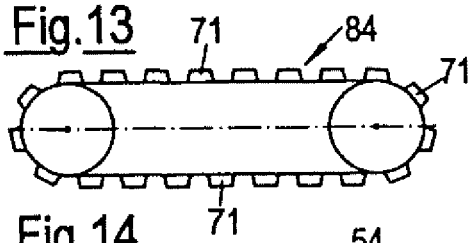
Figure 14:
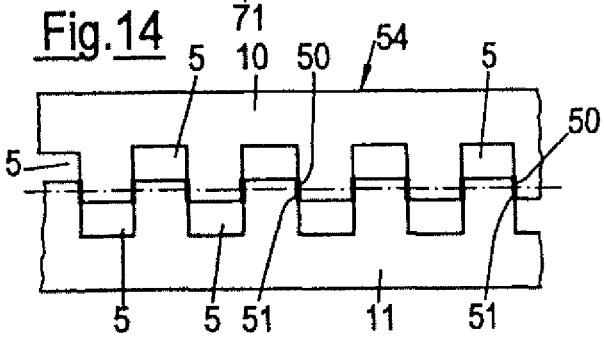
Figure 15:
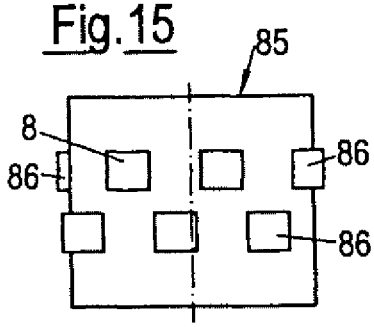
Figure 16:
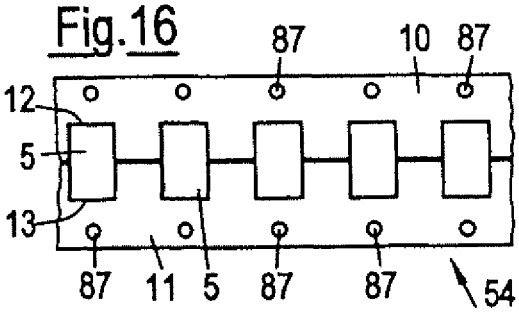
Figure 17:
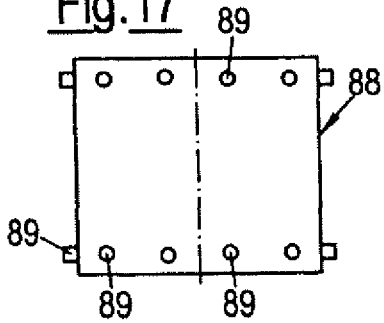
Figure 18:
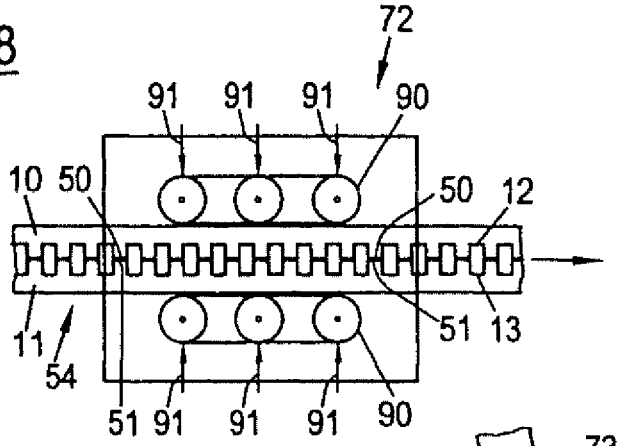
Figure 19:
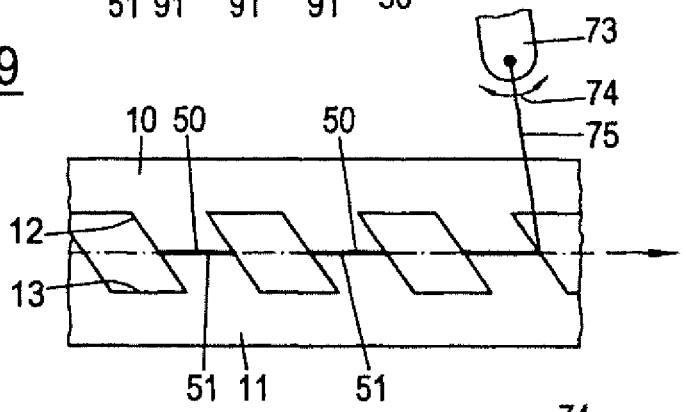
Figure 21:
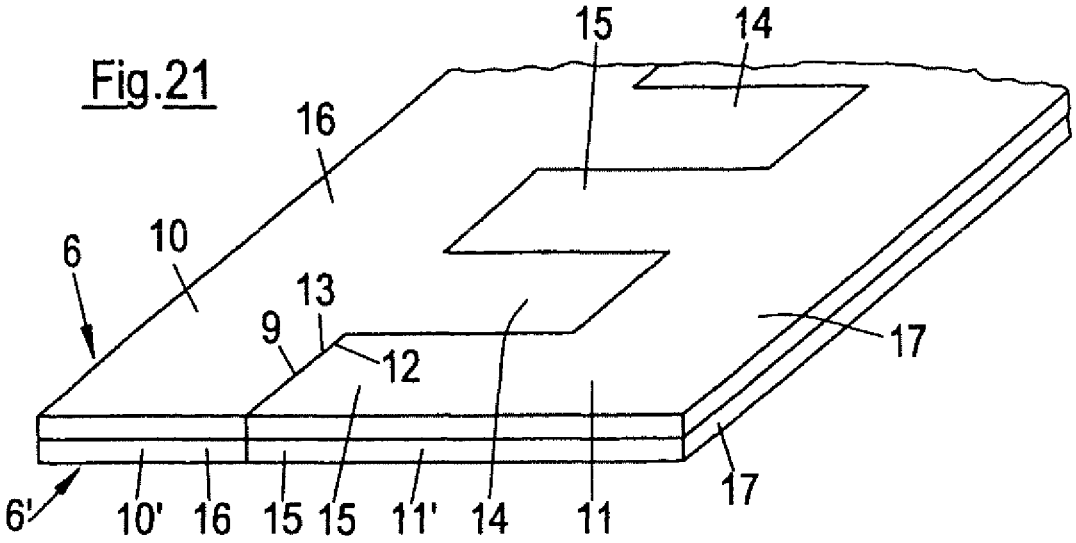
Figure 22:
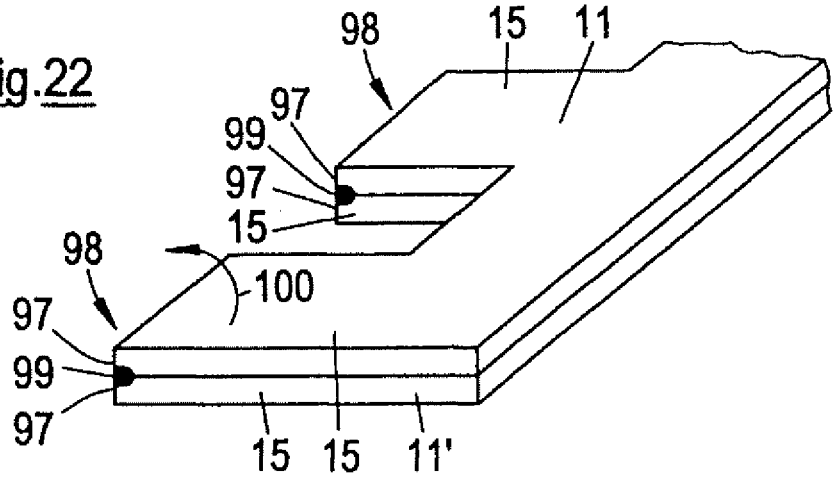

The invention will be described in more detail in the following with reference to embodiments and to the drawings; there are shown in these:

FIG. 1 a schematic perspective representation of a section element manufactured using a method in accordance with the invention or an apparatus in accordance with the invention;

FIGS. 2 to 4 different intermediate steps for the manufacture of a section element in accordance with FIG. 1;

FIGS. 5 and 6 two further section elements;

FIG. 7 a schematic side view of an apparatus formed in accordance with the invention for widening metal elements;

FIG. 8 a side view of a positioning device;

FIG. 9 a plan view of the positioning device in accordance with FIG. 8;

FIG. 10 a plan view of a further positioning device formed in accordance with the invention;

FIG. 11 a plan view of a section element cooperating with a positioning device;

FIG. 12 a further embodiment of a positioning device formed in accordance with the invention;

FIG. 13 a side view of a further positioning device formed in accordance with the invention;

FIG. 14 a further section element;

FIG. 15 a further positioning device;

FIG. 16 a further section device;

FIG. 17 a further positioning element;

FIG. 18 a schematic plan view of a part of a welding station formed in accordance with the invention;

FIG. 19 a schematic perspective representation of a section element for illustrating the welding process;

FIGS. 20*a*) to *d*) four steps of the welding process in accordance with the invention in a schematic representation;

FIG. 21 a perspective representation of two mutually contacting material portions for manufacturing a section element in accordance with a further embodiment of the invention;

FIG. 22 an intermediate step in the manufacture of the section element; and

Figure 23:
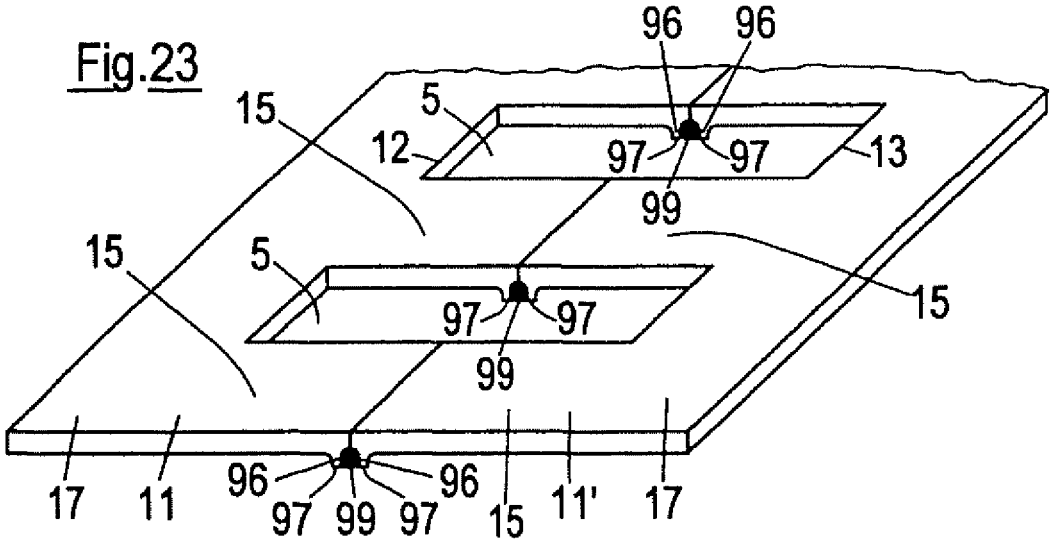

FIG. 23 the section element after the folding open of the two longitudinal portions.

FIG. 1 shows a section element 1 which is made as a C section. The section 1 includes a section body 2 which has a section web 3 as well as two section limbs 4 laterally adjoining thereat which are each angled at a right angle with respect to the section web 3. The free longitudinal edges of the section limbs 4 are in turn each angled by 90° to form the C section. The section element 1 can generally also be made, for example, as a U section, an L section, a T section, an H section, a hat section or a Z section.

A plurality of openings 5 are formed in the section web 3 and can serve, for example, as passage openings for cables or other elements to be laid.

The openings 5 of the section element 2 are manufactured without material loss in accordance with the invention, as will be explained in more detail in the following with reference to FIGS. 2 to 4.

FIG. 2 shows a metal element 54 in the form of a material strip 6, for example a strip of sheet metal, which serves as a starting material for the section body 2. Whereas in FIGS. 2 to 4, only one relatively narrow region of the material strip 6 is shown in each case which is ultimately used to form the section web 3, further material regions can in each case adjoin its outer edges 7, 8, with the section limbs 4, for example, being formed by said further material regions by corresponding bending over.

A meandering slit 9 which extends in the longitudinal extent of the material strip 6 and by which the material strip 6 and thus the section body 2 is divided into two separate longitudinal portions 10, 11 is formed in the material strip 6. The longitudinal portions 10, 11 are each given meandering longitudinal edges 12, 13 by the meandering slit 9 which contact one another seamlessly in the representation in accordance with FIG. 2. The meandering longitudinal edges 12, 13 each include edge portions extending in the longitudinal direction and extending perpendicular thereto.

Web-shaped connection portions 14, 15 of the longitudinal portions 10, 11 are respectively formed by the meandering longitudinal edges 12, 13 and are each connected in one piece to elongated portions 16, 17 of the longitudinal portions 10, 11 and project laterally beyond them. As can furthermore be recognized from FIG. 2, the web-shaped connection portions 14 are bordered by the meandering longitudinal edge 12 and the web-shaped connection portions 15 are bordered by the meandering longitudinal edge 13.

To produce the final shape of the section web 3, the two longitudinal portions 10, 11 are moved apart in accordance with two arrows 18, 19 transverse to the longitudinal extent of the material strip 6 until they adopt the position shown in FIG. 3. In this position, connection edges 20, 21 of the connection portions 14, 15 extending in the longitudinal direction of the longitudinal portions 10, 11 lie on a straight line 22 which is shown by dashed lines and which likewise extends in the longitudinal direction of the longitudinal portions 10, 11.

In accordance with FIG. 4, in a next step, the two longitudinal portions 10, 11 are displaced with respect to one another in accordance with arrows 25, 26 in the longitudinal direction of the longitudinal portions 10, 11 until a respective connection portion 14 lies opposite a connection portions 15. In this position, a respective connection edge 20 accordingly contacts a connection edge 21, as is shown in FIG. 4.

Subsequently, the longitudinal portions 10, 11 are welded to one another, for example laser welded, along the mutually contacting connection edges 20, 21, whereby the final shape of the section web 3 with the openings 5 is achieved.

In FIG. 4, stiffening beads 30, 31 are drawn by dashed lines and extend, on the one hand, in the longitudinal direction of the material strip 6 and, on the other hand, transversely thereto. An increased stiffness of the section element produced is achieved by the stiffening beads 30, 31.

The embodiment in accordance with FIG. 5 differs from the embodiment in accordance with FIGS. 2 to 4 in that the two longitudinal portions 10, 11 are only pulled apart transverse to the longitudinal extent of the material strip 6 so far that the connection portions 14, 15 still engage into one another in the manner of a comb, as is shown in FIG. 5. In this position, the edges of the connection portions 14, 15 contacting one another end-to-end form the connection edges 20, 21 which are butt welded to one another.

In the embodiment in accordance with FIG. 6, the connection portions are made as hexagonal connection portions 37, 38. The hexagonal connection portions 37, 38 each include an hexagonal region 39 as well as a trapezoidal region 40 which adjoins thereat and which is respectively connected to the elongated portions 16 and 17 respectively. The connection edges 20, 21 are made as obliquely extending edges of the hexagonal regions 39 and in particular extend at a 45° angle to the longitudinal extent of the material strip 6. The connection edges 20, 21 and edges 41 of the hexagonal regions 39 adjoining thereat each include an angle of 90° so that corresponding angles $\alpha$, $\beta$ of the openings 5 are also formed as 90° angles.

The connection edges 20, 21 abut one another end-to-end and are, analog to the embodiment in accordance with FIG. 5, butt welded, in particular laser welded, to one another.

Whereas in the embodiment in accordance with FIGS. 2 to 4, the longitudinal portions 10, 11 have to be mutually offset both in the longitudinal direction and transversely thereto, the longitudinal portions 10, 11 in the embodiments in accordance with FIGS. 5 and 6 are only mutually offset transversely to the longitudinal direction of the metal element or transversely to its transport direction.

In all cases, the two longitudinal portions 10, 11 are, however, welded to one another end-to-end via portions 50, 51 of the meandering longitudinal edges 12, 13 so that an exact alignment of the two longitudinal portions 10, 11 to one another is required.

In accordance with the invention, an apparatus is used for this purpose such as is shown schematically, for example in FIG. 7 with reference to an embodiment.

The apparatus includes a feed station 52 at the input side which includes a toll of the elongated ribbon-like metal element 54 wound onto a reel 53. The reel 53 is rotatably supported in accordance with an arrow 55 about an axis of rotation 56 so that the metal element 54 can be unwound from the reel 53 in accordance with an arrow 57.

The metal element 54 is fed via guide rollers 58 to a cutting station 59 which is formed as a rotational cutting apparatus 60 having a rotational cutting roll 61 and a counter-roll 62. A meandering incision 9 such as is shown in FIG. 2 is introduced into the elongated metal element 54 using the rotational cutting apparatus 60. The invention is not restricted to the cutting patterns shown in FIGS. 2 to 6, but any desired meandering incisions can rather be used. In this respect reference is in particular made to DE 10 2010 026 320 in which a variety of suitable cutting patterns is shown. Reference is in particular explicitly made to this document, whose content is explicitly included in the disclosure content of the present application, with respect to the shape of these cutting patterns and to the manner how the longitudinal portions of the metal element created by the cutting pattern are moved apart and ultimately welded to one another.

The metal element 54 provided with the meandering incision 9 is subsequently guided through an straightening station 63 which includes a plurality of alignment rolls 64. The straightening station can generally also include other alignment units such as a press. Upright regions of the metal element 54, which were bent upward in the cutting process in the cutting station 59, for example, are in particular rolled smooth again in the straightening station 63 so that the metal element 54 has a substantially smooth surface after leaving the straightening station 63.

After running through the straightening station 63, the metal element 54 is fed to an offset station 65 in which a slack loop 66 of the metal element 54 is formed. The slack loop 66 is in this respect formed so long that both a moving apart movement of the longitudinal portions 10, 11 of the metal element 54 transversely to the transport direction and a mutual displacement in the transport direction is possible without substantial strains acting on the metal element 54. A corresponding offset in the longitudinal direction by an offset of the two longitudinal portions 10, 11 is shown in FIG. 7.

A positioning station 67 which includes a positioning device 69 formed as a toothed wheel 68 adjoins the offset station 65. The positioning device 69 includes positioning element 71 formed as teeth 70 of the toothed wheel 68 which engage into the openings 5 of the metal element 54 so that the portions 50, 51 of the meandering longitudinal edges 12, 13 to be welded to one another are aligned exactly with one another in predefined positions, such as will be presented in even more detail in the following.

The longitudinal portions 10, 11 of the metal element 54 aligned with one another in this manner are subsequently fed to a welding station 72 which is in particular formed as a laser welding station. A laser welding head 73 which is pivotable in accordance with an arrow 74 so that a laser beam 75 can be pivoted accordingly is arranged within the welding station 72. The pivoting of the laser beam can also take place, for example, by a pivotal mirror or a rotating mirror wheel, with the laser welding head being able to be arranged in a fixed position.

The welding station 72 furthermore includes a vertical belt guide 76 by which the longitudinal portions 10, 11 of the metal element 54 are substantially guided in the same plane. The vertical belt guide 76 can in this respect include upper and lower belt guides 77, 79, for example, in accordance with FIG. 4. Any kind of guide can generally be used with which the two planar longitudinal portions 10, 11 of the metal element 54 are held in parallel next to one another in the same plane. For example, spring-loaded, hydraulic, pneumatic or mechanical guides in the form of rollers, plates, belts or crawlers can be used for this purpose. The guides can in this respect additionally also serve as transport means for the metal element 54 and be formed, for example, as a clamping, magnetic, hydraulic, mechanical or pneumatic transport guide.

A feed unit 79 which can, for example, be formed by two rollers 80 or other suitable elements is provided at the outlet of the welding station 72.

After the feed unit 79, a stamping station and/or a reshaping station 81 is provided in which the metal element 54 can be given an intermediate shape or its final cross-sectional shape, for example a C-shape or a U-shape or another suitable open or closed section shape. The metal element can also be provided with stiffening beads in the stamping station or in the reshaping station.

It can be recognized in FIGS. 8 to 10 that the positioning device 69 can include positioning elements 71 formed, for example, as teeth which can extent either over the total width of the positioning device 69 formed as a toothed wheel 68 or only over a part thereof.

It is important that the positioning elements 71 are formed so that they engage in accordance with FIG. 11 into the openings 5 of the metal element 54 such that a clear positional fixing of the longitudinal portions 10, 11 takes place in the longitudinal direction and/or in the transverse direction. It is, for example, shown in FIG. 11 how the two longitudinal portions 10, 11 are arranged offset with respect to the starting position shown in FIG. 3 by half a period of the meandering incision 9 in the longitudinal direction and are held in this position non-displaceably with respect to one another in the longitudinal direction by a positioning element 71, shown hatched, of the positioning device 69. Since the two longitudinal portions 10, 11 are still formed in one piece in the upstream cutting station 59 or are disposed closer to one another after the cutting process than in the offset station 65, only a fixing of the longitudinal portions 10, 11 in the longitudinal direction is absolutely necessary since the two longitudinal portions 10, 11 are pressed together in the transverse direction due to their original single-piece formation. To amplify this pressing together even further, lateral guide elements can additionally be provided, as are indicated by rolls 82 in FIG. 11. Instead of the rolls 82, other suitable guide elements such as guide surfaces, plates, crawlers, belts or other suitable elements such as worms, gear racks, toothed belts with dies can also be provided.

It is also possible that, in accordance with FIG. 12, corresponding peripheral shoulders 83 are provided at the positioning device 69 itself by which a corresponding guidance of the outer edges of the metal element 54 is ensured.

It is shown schematically in FIG. 13 that the positioning device can also be formed as an in particular endless belt-like or chain-like positioning device 84. A guidance of the metal element 54 over a longer path section is thereby ensured so that the guidance is again improved.

FIGS. 14 and 15 show how a section element in accordance with FIG. 5 can be guided using a positioning device in accordance with the invention. In the section element in accordance with FIG. 14, the two longitudinal portions 10, 11 are only mutually displaced in the transverse direction, whereby the openings 5 are formed. The openings 5 are in this case arranged alternatingly offset with respect to one another, as can be seen from FIG. 14.

In a corresponding manner, in the roll-like positioning device 85 shown in FIG. 15, the positioning elements 86 are likewise arranged alternatingly. The positioning device 85 thus includes two rows of positioning elements 86 arranged lying next to one another in the longitudinal direction, with the positioning elements 86 of the two rows being arranged offset to one another in each case in the transport direction.

Both an exact offset of the two longitudinal portions 10, 11 transverse to the transport direction and an exact alignment in the transport direction are thus ensured using the positioning device 85 in accordance with FIG. 15 so that the portions 50, 51 of the meandering longitudinal edges 12, 13 which should be welded to one another contact one another exactly.

FIGS. 16 and 17 show that the openings used for the alignment of the longitudinal portions 10, 11 do not necessarily have to be formed by the meandering longitudinal edges 12, 13, but can rather also be formed as separate openings 87. These openings 87 are in particular formed in the marginal regions of the longitudinal portions 10, 11 and can, for example, ensure an alignment of the two longitudinal portions 10, 11 with respect to one another in accordance with the principle of traction, for example. The positioning device 88 shown in FIG. 17 can thus have corresponding pins 89 or needles arranged in the marginal region which are formed for engaging in the openings 87. The pins 89 or needles can in this respect, as shown in FIG. 17, be arranged on a roll-like base body or, for example, in accordance with FIG. 13, can be provided at a belt conveyor or chain conveyor.

It can be recognized in the plan view of the welding station 72 in accordance with FIG. 18 that it includes two lateral belt guides 90 which are in turn formed only by way of example as belt guides. The lateral belt guides 90 can again be formed in any other suitable manner, for example by roller guides, plate guides, chain guides or by other suitable guide elements. It is important that the corresponding guides exert in accordance with arrows 91 a force onto the two longitudinal portions 10, 11 of the metal element 54 so that the portions 50, 51 of the meandering longitudinal edges 12, 13 to be welded together come into contact with one another and can optionally easily be pressed toward one another. The belt guides can in this respect additionally also serve as transport means for the metal element 54 and can be formed, for example, as clamping, magnetic, hydraulic, mechanical or pneumatic transport guides, in particular with a correction possibility.

The welding by means of the laser welding head 73 will be described in more detail in the following with reference to FIGS. 19 and 20.

FIG. 19 first shows in a schematic perspective representation the two longitudinal portions 10, 11 which are arranged in the welding station 72 so that the portions 50, 51 of the meandering longitudinal edges 12, 13 to be welded to one another contact one another. The laser welding head 73 is formed so that the laser beam 75 is directed to the two mutually contacting portions 50, 51 and can be pivoted in accordance with the arrow 74 so that the laser beam 75 is ultimately guided along the mutually contacting portions 50, 51.

Figure 20:
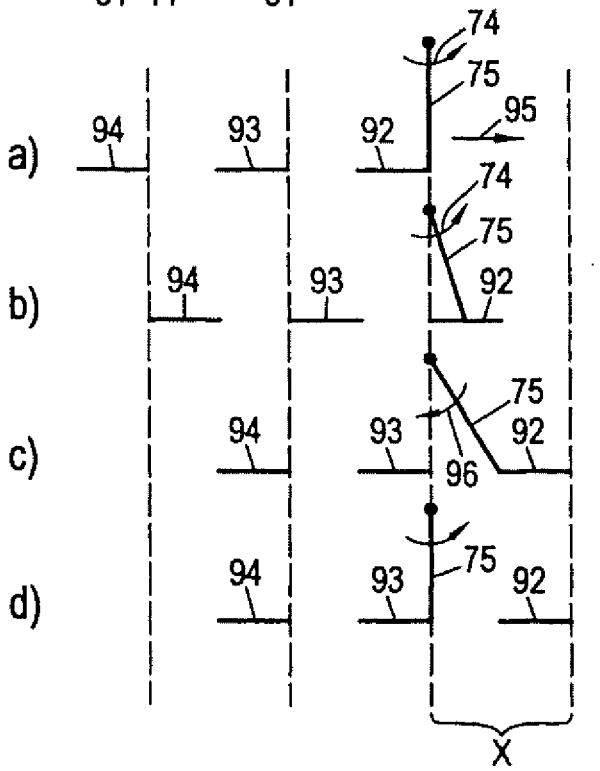

The guidance of the laser beam 75 in this respect takes place as shown in FIGS. 20*a*) to *d*). In this respect, three respective mutually following portions 50, 51 to be welded are shown in FIG. 20 by lines 92, 93, 94 which move from left to right in accordance with the movement of the metal element 54 in FIGS. 20*a*) to *c*).

At the time shown in FIG. 20*a*), the laser beam 75 is incident onto the right hand end of the portions 50, 51 shown by the line 92. The metal element 54 is moved in accordance with an arrow 95 in the transport direction, with the laser beam 75 simultaneously being guided in accordance with the arrow 74 in the same direction, but at half the speed.

At the time shown in FIG. 20*b*), the metal element 54 has already covered the path 0.5×, whereas the laser beam 75 was only pivoted so that the welding spot incident on the metal element 54 has covered the path 0.25×. At this time, the portions 50, 51 are half welded to one another along the line 92.

When the metal element 54 in accordance with FIG. 20*c*) has moved by the path x in the transport direction, the welding spot of the laser beam 75 incident on the metal element 54 has covered the path 0.5× and is thus located in accordance with FIG. 20*c*) at the left hand end of the line 92 which represents the weld seam and is thus completed.

At this time, the laser beam is pivoted in accordance with an arrow 101 quickly against the previous adjustment direction to the right hand end of the next weld seam to be produced shown by the line 93 or is directly positioned there, whereupon this weld seam is produced in the same manner.

The transport speed of the metal element 54 can be set twice as high as the maximum possible welding speed by this intermittent welding so that the throughput for the production of the welded section element can be considerably increased.

A multiplication of the transport speed can be achieved in a corresponding manner by the use of a plurality of laser beams 75 extending in parallel.

In FIG. 21, two substantially equally thick, flat material strips 6, 6' are arranged so that they lie flat over one another. A uniform meandering slit 9 was introduced into both material strips 6, 6' by which the material strips 6, 6' are divided into two longitudinal portions 10, 11 and 10', 11' respectively. In contrast to the previously described embodiments, in this embodiment the section element 1 is not formed by the originally contiguous longitudinal portions 10, 11 or 10', 11' respectively, but two section elements are rather formed of which one comprises the longitudinal portions 10, 10' and the other the longitudinal portions 11, 11'.

For this purpose, after producing the meandering slit 9, the longitudinal portions 10, 10' lying over one another are together separated from the respective other longitudinal portions 11, 11' in order together to form section elements independent of one another.

In FIGS. 22 and 23, the manufacture of the section element 1 with the longitudinal portions 11, 11' is shown by way of example. The longitudinal portions 11, 11' lying over one another are welded together at connection edges 97 extending in the longitudinal direction so that weld seams 99 are produced which extend along the end faces 98 of the connection edges 97. Subsequently, the longitudinal portions 11, 11' are folded apart, as is indicated by an arrow 100 in FIG. 22. For this purpose, the longitudinal portion 11 is, for example, pivoted by approximately 180° about the connection edges 97 in accordance with the arrow 100 until it adopts the position shown in FIG. 23. In this position, the longitudinal portions 11, 11' lie substantially in a common plane.

The mutually connected connection edges 97 are bent over by the pivoting so that they form bent-over abutment edges 96 via which the longitudinal portions 11, 11' are connected to one another end-to-end. At the same time, the openings 5 are formed by the pivoting between portions of the meandering longitudinal edges 12, 13, without this being associated with material loss.

The connection between the bent-over abutment edges 96 can generally also be produced by other kinds of connection such as overlap welding, folding, adhesive bonding, clinching, riveting or clamping. This also applies to the connection of the portions of the meandering longitudinal edges for all other embodiment described in this application. In addition, the pivoting of the longitudinal portions can also take place about an angle different from 180°, in particular about a smaller or also larger angle, depending on which shape the final section element should have. The manufacture of the section element by folding open was admittedly only explicitly described in connection with the web-shaped connection portions 14, 15, but this manufacture is also possible with the other connection portions described within the framework of this application as long as the connection edges to be connected extend in the longitudinal direction of the material strip.

Individual elements of the apparatus in accordance with the invention can preferably be synchronized with one another. The positioning device and the respectively present feed devices, the guide device and the adjustment of the laser beam can thus be mutually synchronized, for example. In this respect, it is possible that a detection of the movement of the metal element is provided, for example in an optical, mechanical or electronic manner, to realize a corresponding feed regulation, for example by means of a closed loop.

Furthermore, during and after completion of the section element, inspection points for checking the quality of the manufactured section element can be provided. They can, for example, check the mutually coinciding portions of the meandering longitudinal edges for minimum offset or the weld seam produced for cleanliness by optical or electronic means.

REFERENCE NUMERAL LIST

1 section element
2 section body
3 section web
4 section limb
5 openings
6, 6' material strip
7 outer edge
8 outer edge
9 meandering slit
10, 10' longitudinal portion
11, 11' longitudinal portion
12 meandering longitudinal edge
13 meandering longitudinal edge
14 web-shaped connection portions
15 web-shaped connection portions
16 elongated portions
17 elongated portions
18 arrow
19 arrow
20 connection edges
21 connection edges
22 line
30 stiffening beads
31 stiffening beads
37 hexagonal connection portions
38 hexagonal connection portions
39 hexagonal regions
40 trapezoidal regions
41 edges

50 portions
51 portions
52 feed station
53 reel
54 metal element
55 arrow
56 axis of rotation
57 arrow
58 guide rollers
59 cutting station
60 rotational cutting apparatus
61 cutting roll
62 counter-roll
63 straightening station
64 alignment rollers
65 offset station
66 loop
67 positioning station
68 toothed wheel
69 positioning device
70 teeth
71 positioning elements
72 welding station
73 laser welding head
74 arrow
75 laser beam
76 vertical belt guide
77 upper belt guide
78 lower belt guide
79 feed unit
80 rollers
81 stamping station/reshaping station
82 rollers
83 shoulders
84 positioning device
85 positioning device
86 positioning elements
87 openings
88 positioning device
89 pins
90 lateral belt guide
91 arrows
92 line
93 line
94 line
95 arrow
96 bent-over abutment edges
97 connection edges
98 end faces
100 weld seams
100 arrow
101 arrow

The invention claimed is:

1. An apparatus designed for expanding elongated, ribbon-shaped metal elements (54) moving in a longitudinal direction and suitable for forming open section elements (1)

having a feed station (52), a cutting station (59), a positioning station (67), and a connection station (72), wherein the feed station (52) is formed for at least substantially continuous feed of at least one metal element (54) to the cutting station (59);

the cutting station (59) is formed for producing at least one continuous meandering incision (9) which extends in the longitudinal direction of the at least one metal element (54) and by which at least two longitudinal portions (t0, 11) of the at least one metal element (54) with meandering longitudinal edges (12, 13) are produced;

the positioning station (67) includes at least one positioning device (69, 84, 85, 88) having a plurality of positioning elements (71, 86), with the positioning elements (71, 86) being formed in predefined positions for engaging into openings (5, 87) formed in the at least one metal element (54) and for positioning portions (50, 51) of the meandering longitudinal edges (12, 13) with respect to one another;

and wherein the connection station (72) is formed for connecting the mutually positioned portions (50, 51) of the meandering longitudinal edges (12, 13).

2. An apparatus in accordance with claim 1, wherein an offset station (65) for forming a loop (66) of at least one of the longitudinal portions (10, 11) of the metal element (54) is provided between the cutting station (59) and the positioning station (67) so that the mutually separate longitudinal portions (10, 11) of the at least one metal element (54) can be mutually offset in at least one of the longitudinal direction and the transverse direction.

3. An apparatus in accordance with claim 1, wherein two respective rows of the positioning elements (71, 86) disposed next to another in the transport direction are provided.

4. An apparatus in accordance with claim 3, wherein the positioning elements (71, 86) of the two rows are not arranged mutually offset in the transport direction.

5. An apparatus in accordance with claim 3, wherein the positioning elements (71, 86) of the two rows are arranged mutually offset in the transport direction.

6. An apparatus in accordance with claim 1, wherein the positioning device (69, 84, 85, 88) is formed as one of a toothed wheel (68), a toothed belt, a gear rack, a chain conveyor and a belt conveyor having the positional elements (71, 86).

7. An apparatus in accordance with claim 1, wherein the positioning elements (71, 86) have a cross-sectional shape formed substantially complementary to the openings (5, 87) of the at least one metal element (54).

8. An apparatus in accordance with claim 1, wherein the positioning elements (71, 86) are formed for engaging in the openings (5), the openings being formed by the meandering longitudinal edges (12, 13).

9. An apparatus in accordance with claim 1, wherein the positioning elements (71, 86) are formed for engaging in the openings (87), the openings being provided independently of the meandering longitudinal edges (12, 13) in the at least one metal element (54).

10. An apparatus in accordance with claim 1, wherein the feed station (52) includes a reel (53) on which the at least one metal element (54) is wound.

11. An apparatus in accordance with claim 1, wherein the feed station (52) includes an apparatus for welding together mutually following metal elements (54).

12. An apparatus in accordance with claim 1, wherein a straightening station (63) for the at least one metal element (54) is provided between the feed station (52) and the cutting station (59) and/or between the cutting station (59) and the positioning station (67).

13. An apparatus in accordance with claim 1, wherein the positioning device (69, 84, 85, 88) is made actively driven.

14. An apparatus in accordance with claim 1, wherein the positioning station (67) is arranged in front of the connection station (72).

15. An apparatus in accordance with claim 1, wherein the positioning station (67) is arranged after the connection station (72).

16. An apparatus in accordance with claim 1, wherein the connection station (72) includes a lateral belt guide (90) by which the longitudinal portions (10, 11) of the at least one metal element (54) are positioned with respect to one another.

17. An apparatus in accordance with claim 16, wherein the longitudinal portions (10, 11) are held together so that the portions (50, 51) of the meandering longitudinal edges (12, 13) to be welded together contact one another.

18. An apparatus in accordance with claim 1, wherein the connection station (72) includes a vertical belt guide (76) by which the longitudinal portions (10, 11) of the at least one metal element (54) are guided substantially in the same plane or lying areally on one another.

19. An apparatus in accordance with claim 1, wherein the cutting station (59) includes one of a rotational cutting apparatus (60) and a laser cutting apparatus.

20. An apparatus in accordance with claim 1, wherein the connection station (72) is formed as a welding station (72).

21. An apparatus in accordance with claim 20, wherein the welding station (72) comprises a laser welding apparatus (73, 75).

22. An apparatus in accordance with claim 1, wherein a feed unit (79) for the metal element (54) is provided.

23. An apparatus in accordance with claim 1, wherein at least one of a stamping station (81) and a reshaping station (81) for the at least one metal element (54) is/are provided after the connection station (72).

24. A method of expanding elongated, ribbon-shaped metal elements (54) moving in a longitudinal direction and suitable for forming open section elements (1), wherein at least one metal element (54) is fed at least substantially continuously to a cutting station (59) by a feed station (52);

at least one continuous meandering incision (9) is produced which extends in the longitudinal direction of the at least one metal element (54) and by which at least two longitudinal portions (10, 11) of the at least one metal element (54) having meandering longitudinal edges (12, 13) are produced;

the longitudinal portions (10, 11) are guided through a positioning station (67) so that positioning elements (71, 86) provided at a positioning device (69, 84, 85, 88) engage into openings (5, 87) formed in the at least one metal element (54) so that portions (50, 51) of the meandering longitudinal edges (12, 13) are mutually positioned in predefined positions;

and the mutually positioned portions (50, 51) of the meandering longitudinal edges (12, 13) are connected to one another in a connection station (72).

25. A method in accordance with claim 24, wherein the at least one metal element (54) is fed to an offset station (65) in which a loop (66) of at least one of the longitudinal portions (10, 11) of the at least one metal element (54) is formed so that the mutually separate longitudinal portions (10, 11) of the at least one metal element (54) can be mutually offset in at least one of the longitudinal direction and the transverse direction.

26. A method in accordance with claim 24, wherein the mutually positioned portions (50, 51) of the meandering longitudinal edges (12, 13) are welded to one another.

27. A method in accordance with claim 26, wherein the mutually positioned portions (50, 51) are laser welded to one another by means of a laser beam (75), with the laser beam (75) being moved along with the moving at least one metal element (54) during the welding process, with the forward movement of the laser beam (75) being slower than the transport speed of the at least one metal element (54).

28. A method in accordance with claim 27, wherein the forward movement of the laser beam (75) and thus the welding speed is substantially half as fast as the transport speed of the at least one metal element (54).

29. A method in accordance with claim 27, wherein after welding two mutually positioned portions (50, 51) of the meandering longitudinal edges (12, 13), the laser beam (75) is positioned onto portions (50, 51) of the meandering longitudinal edges (12, 13) disposed opposite to the transport direction and these are subsequently welded to one another.

30. A method in accordance with claim 24, wherein at least two areally mutually contacting metal elements (54) are fed to the cutting station (59);

the mutually contacting metal elements (54) are jointly divided by the meandering incision (9) in the cutting station (59) into two longitudinal portions (10, 10', 11, 11') each, with the respective longitudinal portions (10, 10', 11, 11') of the metal elements (54) disposed on the same side of the meandering incision (9) mutually areally contacting and portions (50, 51) of the meandering longitudinal edges (12, 13) of the mutually contacting longitudinal portions (10, 10', 11, 11') respectively extending in the longitudinal direction forming directly mutually contacting connection edges (97);

the one mutually contacting longitudinal portions (10, 10') are separated from the other mutually contacting longitudinal portions (11, 11');

the connection edges (97) of the one longitudinal portion (10, 11) are connected to the connection edges (97) of the longitudinal portion (10', 11') lying on it; and one of the two longitudinal portions (10, 10', 11, 11') is pivoted about the connection edges (97) with respect to the other longitudinal portion (10, 10', 11, 11') connected to it so that the longitudinal portions (10, 10', 11, 11') are connected to one another along bent over abutment edges (96) and the openings (5) are formed between portions of the meandering longitudinal edges (12, 13).

* * * * *